US005738351A

United States Patent [19]

Booth

[11] Patent Number: 5,738,351

[45] Date of Patent: Apr. 14, 1998

[54] APPARATUS AND METHOD OF PLAYING A PUBLICATION GAME

[75] Inventor: Michael J. Booth, Long Branch, N.J.

[73] Assignee: Atlanticville Communications, Inc., Long Branch, N.J.

[21] Appl. No.: 831,220

[22] Filed: Apr. 2, 1997

[51] Int. Cl.[6] ..... A63F 3/06

[52] U.S. Cl. ..... 273/139; 273/138.1; 283/49; 283/51; 283/81; 283/901; 283/903

[58] Field of Search ..... 273/139, 138.1, 273/269; 283/901, 903, 49, 51, 56, 81

[56] References Cited

U.S. PATENT DOCUMENTS

| | | | |
|---|---|---|---|
| 4,285,520 | 8/1981 | Small | 273/240 |
| 4,634,149 | 1/1987 | Donovan | 283/102 |
| 4,725,077 | 2/1988 | Fujita | 283/67 |
| 4,953,895 | 9/1990 | Goussios | 283/102 |
| 5,007,641 | 4/1991 | Seidman | 273/138.2 |
| 5,080,364 | 1/1992 | Seidman | 273/138.2 |
| 5,417,424 | 5/1995 | Snowden et al. | 273/138.2 |
| 5,472,209 | 12/1995 | Goldfarb | 273/269 |
| 5,484,169 | 1/1996 | Chang et al. | 283/67 |
| 5,489,096 | 2/1996 | Aron | 273/138.1 |
| 5,497,990 | 3/1996 | Nanni | 273/138.2 |
| 5,551,962 | 9/1996 | Pettit et al. | 273/143 R |

OTHER PUBLICATIONS

Publishers Clearing House, Prize Claim Form, Dec. 26, 1996, Dec. 1996.

Atlanticville Shore Shopper, Long Branch, New Jersey, "The Numbers Gams", p. 4, Sep. 1997.

*Primary Examiner*—Benjamin H. Layno

*Attorney, Agent, or Firm*—Lerner, David, Littenberg, Krumholz & Mentlik

[57] ABSTRACT

A game of chance is provided in association with a mass mailing publication. The game of chance includes particular indicia identified on a mailing label and prize indicia identified at a selected location within the publication in correspondence with certain identified prizes. In order to win such identified prizes, all the player needs to do is to verify that the assigned indicia on the mailing label matches the prize indicia. The player may then claim his or her prize.

12 Claims, 3 Drawing Sheets

APPARATUS AND METHOD OF PLAYING A PUBLICATION GAME

FIELD OF THE INVENTION

The present invention relates to games of chance. More particularly, the present invention relates to a publication game of chance where players can win valuable prizes.

BACKGROUND OF THE INVENTION

Great efforts have been exerted by marketing and sales personnel to increase the circulation of publications and/or the interest in such publications. Such efforts have been made, in part, because of the logical nexus between the distribution size of a publication and the advertising revenues generated by the publication. It is known, for example, that discount coupons are placed in publications such as newspapers and magazines to increase interest in the publication.

Additional efforts to increase the interest in publications have been made by incorporating various games therein which are fun and interesting to recipients of the publication. For example, U.S. Pat. No. 4,285,520 discloses a bingo-type game which is printed in a mass circulation publication, such as a newspaper. More particularly, this patent discloses a mass circulation bingo game in which players match certain indicia identified in coupons within a publication, such as a newspaper. The indicia is displayed in a bingo-type matrix within the publication to ascertain whether the players have won prizes identified on the coupons. The game disclosed in this patent does not include numbers identified on mailing labels which must be matched with numbers set forth at a specific location, or in association with advertisements, within the corresponding publication.

Another prior art game that was disclosed in a widely distributed newspaper required players to match serial numbers on currency bills with numbers set forth in the newspaper publication. If a match exists between the numbers on an individual's currency bill, such as a dollar bill, and the numbers identified in the newspaper publication, the individual would win a preselected prize. This game did not include a mailing label on the publication where the mailing label displayed game indicia which was reviewed by the recipient and compared with indicia within the publication to determine if a corresponding prize has been won.

Notwithstanding the aforementioned prior art publication games, a need has persisted to develop a new publication game which is particularly fun for the players and effective at increasing the circulation and interest in the publication.

SUMMARY AND OBJECTS OF THE INVENTION

The present invention addresses the needs and provides a game of chance which is designed to increase interest in a mass mailing publication which may result in increased advertising revenue.

As used herein, the term "publication" is intended to cover any mass circulated or distributed publication which may include newspapers, home shopping publications, real estate publications, magazines, total market pieces, targeted advertising brochures, department store pamphlets, or the like.

The present invention contemplates mailing of the subject publication to residents of a selected area. A mailing label is provided on the publication which includes the address of the recipient and as a predetermined or a randomly generated number or other indicia. Such other indicia may comprise letters, a combination of letters and numbers, colors, shales and the like. In a preferred embodiment, the numbers or other indicia are printed directly on the mailing label which is placed on the publication. In order to play the subject game, the recipients of the publication simply have to review the indicia printed on their mailing label and compare it to indicia displayed at a selected location in the publication. If the indicia on the mailing label matches the printed indicia in the publication, the resident would win a corresponding prize identified in the publication. In an embodiment where the indicia comprises letters, colors, shapes and the like, the mailing label indicia would still need to be matched with corresponding indicia associated with prizes in the publication for a player would be considered a winner of the identified prize.

Alternate embodiments of the subject game may include placement of indicia directly on advertisements within the publication. In this embodiment, the players would simply compare the indicia on their mailing label with the indicia displayed in the various advertisements throughout the publication to determine whether they have won the prize identified in such advertisements.

In accordance with a preferred aspect of the present invention, a publication game of chance is provided. The game comprises a publication which includes at least one page. The publication is preferably widely distributed, but may include any number of recipients. Prize information identifying one or more prizes is printed in the publication. First indicia is also printed in the publication which corresponds to the prize information. The first indicia may comprise numbers, letters, colors, shapes or the like. Mailing labels are also provided, each mailing label being affixed to one copy of the publication. Each mailing label may include the recipient's address and second indicia displayed thereon. The second indicia on at least one of the mailing labels will correspond to the first indicia and thus will be considered winning indicia, whereby one or more recipients who receive a copy of said publication including the winning indicia is entitled to claim the prize identified by the corresponding prize information.

In one embodiment of the present invention, the second indicia may be unique for each of the mailing labels. As indicated above, such second indicia may comprise numbers, letters, colors, shapes or the like.

The prize information may comprise a single prize or listing of a plurality of prizes. In the latter embodiment, the first indicia may comprise a plurality of separate entries which correspond to respective ones of the listed prizes. In another embodiment, each of the second indicia may correspond with only one of the entries of the first indicia. In yet a further embodiment, the prize information may comprise printed information on a coupon, and the first indicia may comprise at least one entry corresponding with the coupon.

The publication game of the present invention may comprise various types of publications. In a preferred embodiment, it is selected from the group consisting of newspapers, home shopper publications and magazines.

Preferably, each of the mailing labels will include one set of the second indicia. The second indicia may comprise consecutively numbered indicia, randomly assigned indicia or other generated indicia.

In another preferred embodiment, copies of the subject publication need not be directly mailed to residents of a selected area. Instead, the publication could be placed at selected locations to be picked up by persons interested in the publication. Alternatively, the publication can be delivered to residents without use of a mailing label as is common in home newspaper delivery services. In accordance with these alternate preferred embodiments which do not require a mailing label, the second indicia (i.e., the potential winning indicia) may be printed anywhere on the publication, or it can be printed in association with the publication, such as on an insert or the like. In this preferred embodiment, the first indicia (i.e., the prize indicia) would also be associated with prizes. The first indicia and the prize information may be printed directed on the publication, or may be printed in association with the publication as on inserts, as discussed above. Regardless of the location of the winning indicia and the prize indicia, an important aspect of this embodiment of the present invention is that recipients of the publication can substantially immediately determine whether or not they have won an identified prize by matching the winning indicia with the prize indicia. The recipients would then be entitled to claim the prize that corresponds with the prize indicia and the matching winning indicia.

It should be appreciated that when the first or second indicia is described herein as being "in association with a publication," such relationship is intended to cover placement of such indicia or prize information in various locations, including directly on the publication, or on inserts which may be placed within or next to the publication upon delivery to the recipients thereof.

In accordance with a further aspect of the present invention, a method of playing a game of chance is provided. The method may comprise the steps of receiving a publication in the mail; examining a mailing label provided on the publication and identifying indicia printed on said mailing label; examining at least a portion of the publication and identifying prize indicia and corresponding with said prizes printed in the publication; and comparing the mailing label indicia with the prize indicia to determine if a match exists between such indicia, whereby upon detection of a match the player is entitled to claim the prize corresponding to the prize indicia.

It is an object of the present invention to provide a game of chance to be played in association with a mass distributed publication which is fun for the recipient.

It is a further object of the present invention to provide a game of chance in connection with a mass mailing publication that will result in increased advertising revenue to the publication owner.

These and other objects, features and advantages of the present invention will be more clearly understood when read in conjunction with the accompanying drawings and the following detailed description of the preferred embodiments.

DETAILED DESCRIPTION OF THE PREFERRED EMBODIMENTS

Figure 1:
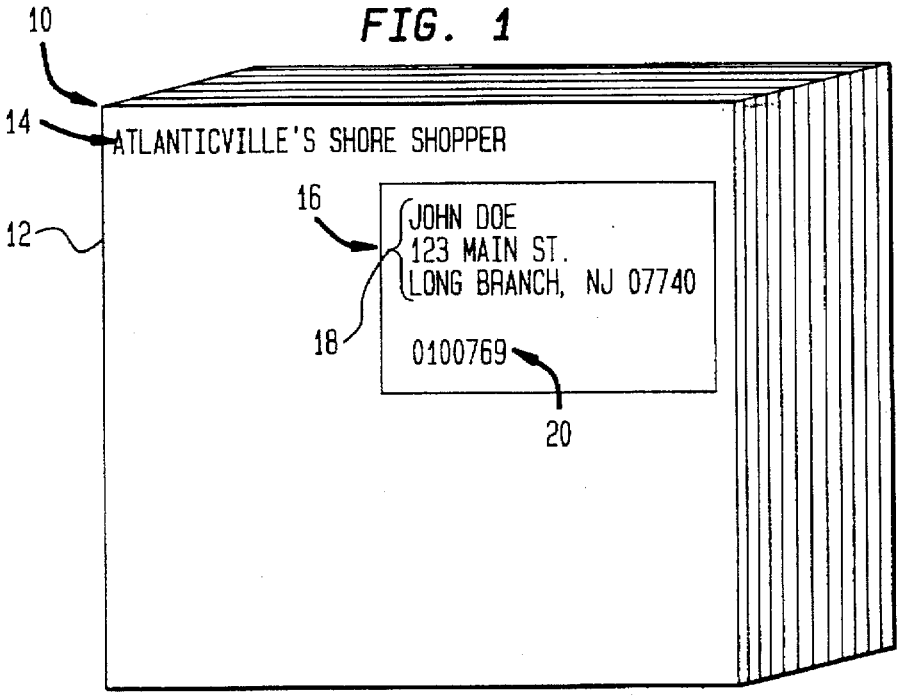
FIG. 1 is a schematic illustration of a publication including a mailing label thereon where the mailing label includes mailing indicia.
Figure 2:
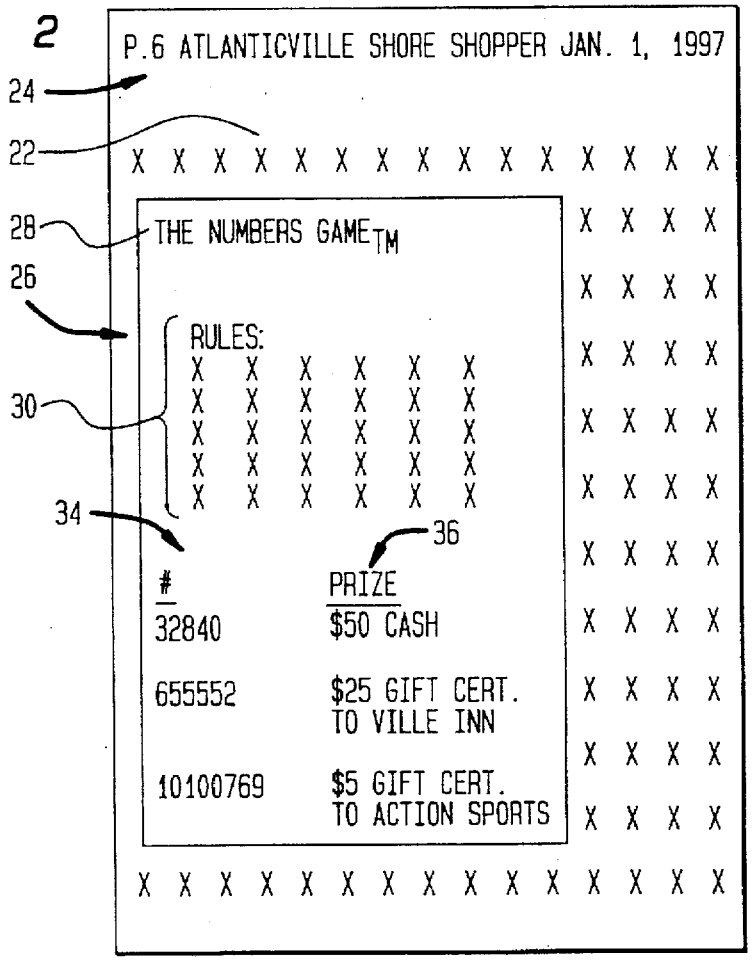
FIG. 2 is a schematic illustration of one embodiment of the present invention where a plurality of prize indicia is listed in correspondence with asserted prize information on a page of a publication.
Figure 3:
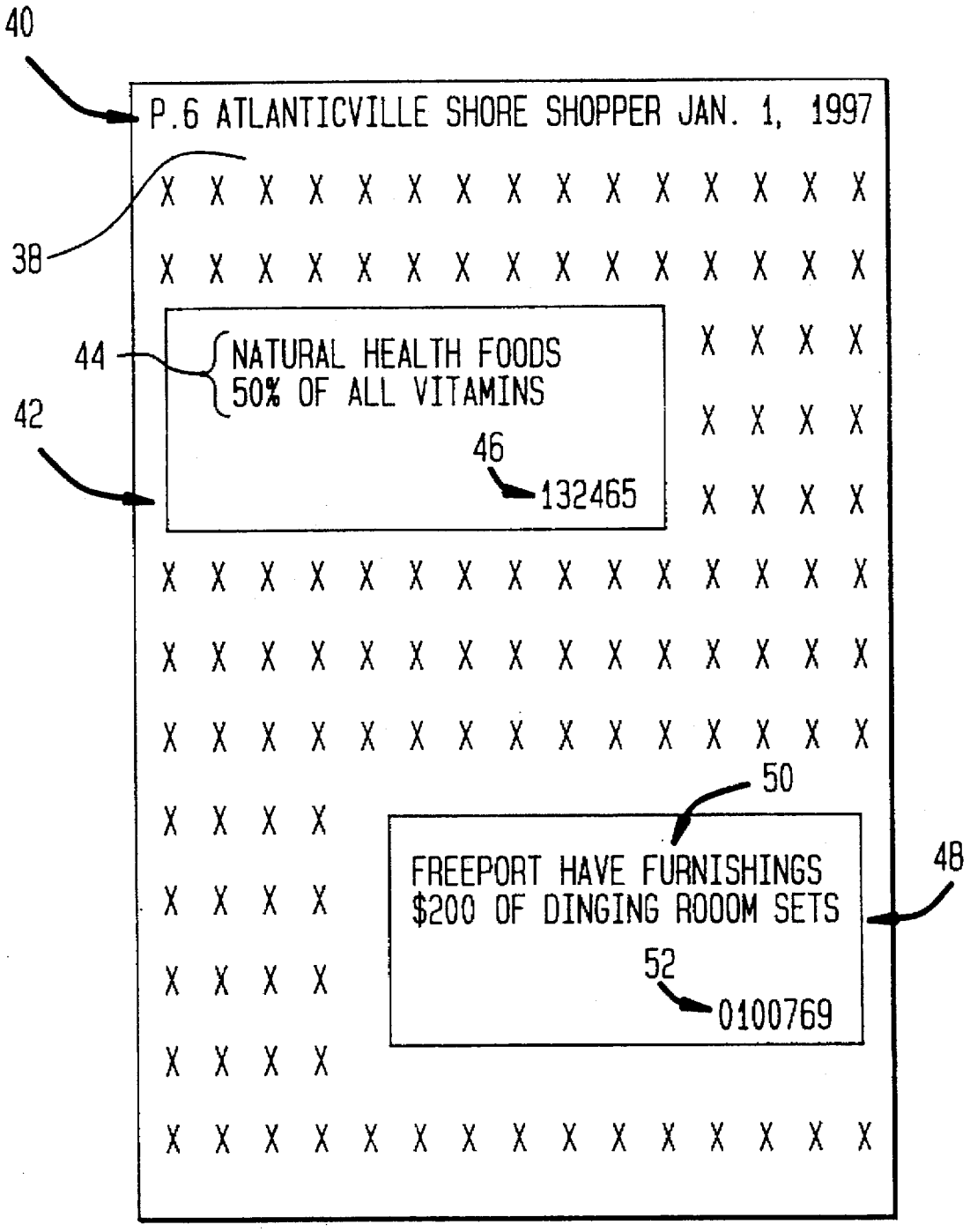
FIG. 3 is a schematic illustration of a second embodiment of the present invention where the publication includes a plurality of coupons and the prize indicia is printed in association with the coupons.

A game of chance in accordance with preferred embodiments of the present invention is schematically illustrated in FIGS. 1–3. FIG. 1 particularly illustrates a multi-page publication 10 which is intended to be circulated to many persons within a preselected area. In one preferred embodiment, the publication comprises a multi-page advertisement booklet which includes advertisements for local business owners and stories of local interest. Such publications which may be known as "home shoppers", are widely distributed in various towns, counties and cities throughout the United States and internationally. It should be appreciated that the publication 10 may comprise any publication consisting of one or more pages which is intended to be mass-circulated. Such publications may include, for example, newspapers, magazines, home shoppers and the like.

FIG. 1 particularly illustrates a front page 12 of the publication 10 which may typically include a name identified by reference number 14. The name of the publication identified in FIG. 1 is "Atlanticville's Shore Shopper."

A mailing label 16 is shown on the front page 12 of the publication 10 as including an example of a recipient's name and address designated 18. The mailing label 16 also includes mailing label indicia 20 as shown in FIG. 1. This indicia may comprise any combination of numbers, letters, colors or shapes. In the embodiments shown in FIG. 1, the mailing label indicia 20 includes a randomly selected number 0100769. This mailing label indicia is also referred to herein as the "second indicia" (or "winning indicia" when a match exists with the prize indicia). An important aspect of the present invention is the: placement of the mailing indicia 20, which may correspond with said prize indicia as discussed below, directly on the mailing label 16. Such placement of the mailing indicia 20 is particularly cost efficient since the mailing label 16 must be printed in any event.

FIG. 2 illustrates a selected page 22 of the publication 10 in accordance with one embodiment of the present invention. The page 22 may include a heading 24 which includes various information which is often present in newspapers, such as the page number, the name of the publication and the publication date.

Important information regarding the present game of chance may be included within a selected portion or block 26 of the page 22. As shown in FIG. 2, the block 26 includes a trademark, such as THE NUMBERS GAME™, of the game. Instructions for playing the game may also be included within the designated block 26 as shown by reference numeral 30. Various prize indicia and corresponding valuable prizes are designated by reference numeral 32 within the block 26. The prize indicia may be listed under number heading 34 and the valuable prizes may be listed adjacent to the prize indicia under the prize heading 36. For example, as shown in FIG. 2, the number 32840 is shown as the first prize indicia and the corresponding prize is $50 in cash. The second prize indicia is represented by number 655552 which corresponds to a $25 gift certificate for dinner at a local restaurant. The final prize indicia shown in FIG. 2 includes number 0100769 which corresponds with a $5 gift certificate to a local sporting goods store. As used herein, it should be appreciated that the term prize indicia may also be described as the "first indicia" with respect to the claims set forth below.

FIG. 3 illustrates a second embodiment of the present game of chance. In particular, page 38 of the publication 10 may include a similar heading 40 to the heading 24 shown in FIG. 2. However, instead of a list of prize indicia and corresponding valuable prizes arranged within a certain block, this embodiment includes separate coupons bearing prize indicia. More particularly, a coupon 42 is shown as including an advertisement 44 for a local health food store with a valuable discount of 50 percent off of all vitamins sold by the health food store. In this embodiment, the prize indicia is shown by reference numeral 46 as including number 132465. In accordance with this embodiment of the present invention, the recipient of the publication 10 would win the prize identified in the coupon 42 if the mailing label indicia 20 matches the prize indicia 46. Similarly, FIG. 3 shows a second coupon 48 having an advertisement 50 representing a discount at a local furniture store. The coupon 48 also includes prize indicia 52 which is shown as number 0100769.

The instructions and rules for playing the present game of chance are particularly simple and can thus easily be displayed at a selected location within the publication, such as location 30 within the designated block 26 shown in FIG. 2. The game rules may also be displayed on the first page 12 of the publication 10, or at any other convenient location.

Figure 4:
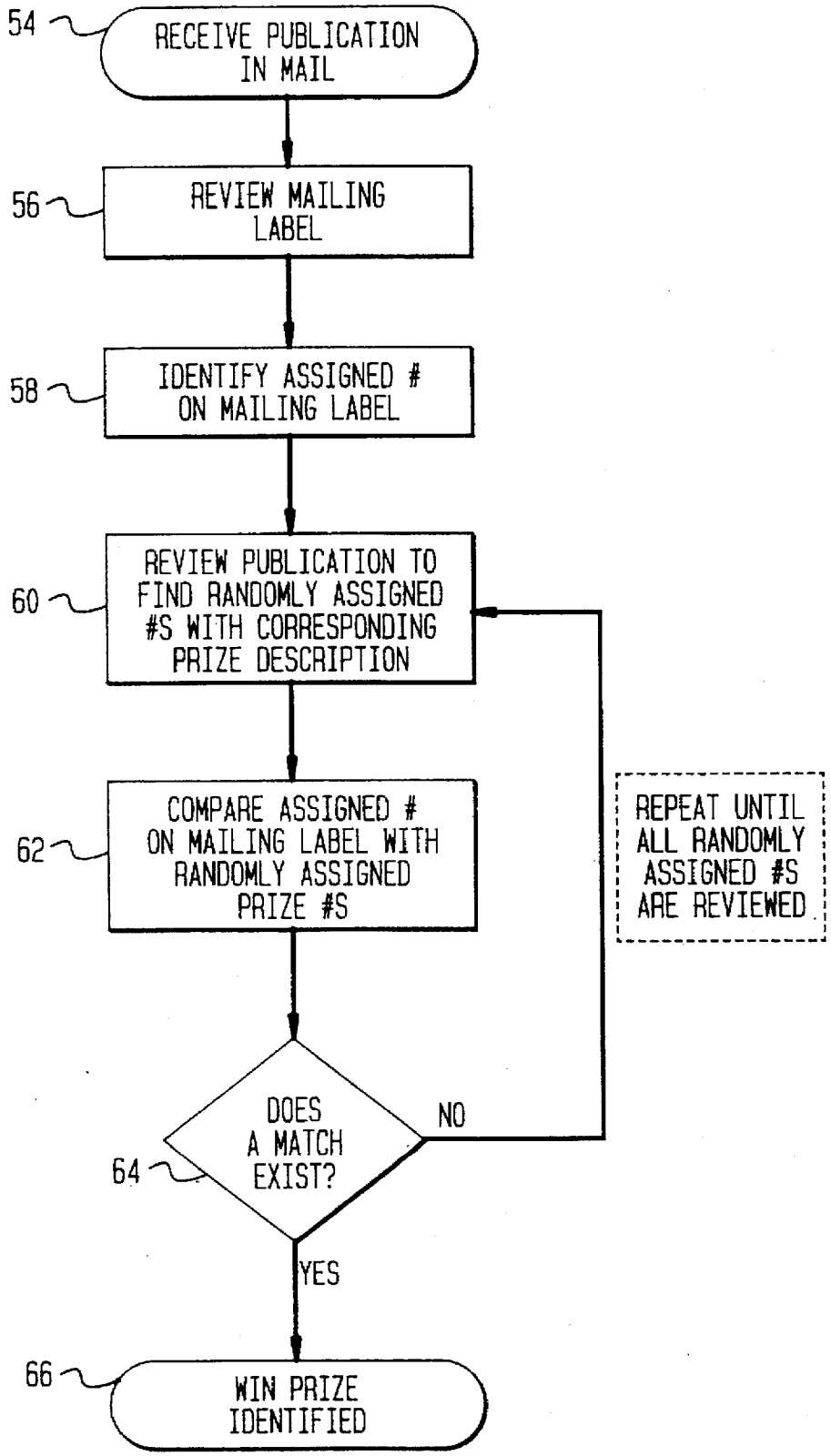
FIG. 4 is a flow chart illustrating basic steps of playing a preferred embodiment of the present game.

FIG. 4 illustrates a flow chart of the general steps of playing the present publication game. Initially, the distributor of the publication would place a mailing label thereon, such as mailing label 16. The mailing label should include the address of the designated recipient and the mailing indicia 20. The publication 10 is then widely distributed to all of its recipients on a mailing list. As shown at step 54, the recipients would initially receive the publication in the mail.

In order to play the present game, the recipients would review their respective mailing labels as indicated at step 56 and would then identify the assigned mailing indicia on the mailing label as indicated at step 58.

The recipient would then review the remainder of the publication as shown at step 60 to find the randomly assigned prize indicia which correspond with certain prize descriptions as indicated by reference number 32 in FIG. 2 and reference numbers 46 and 52 in FIG. 3. At this point, the recipient need only compare the assigned mailing indicia 20 on the mailing label 16 with the randomly assigned prize indicia to determine if a match exists as indicated at steps 62 and 64. If no match exists, the recipient would continue to review the prize indicia and the corresponding prizes to determine if a match exists between the indicia on the recipients mailing label and the prize indicia identified in the publication.

Once a match is determined, the recipient would win the prize which corresponds with the matching prize indicia as indicated at step 66. The recipient may claim his or her prize in various ways. For example, a telephone number may be provided for the recipient to call. Similarly, an address may be provided for the recipient to mail the matching mailing indicia. Alternatively, the recipient may be entitled to directly claim the prize by simply bringing the; publication including the mailing indicia thereon and the corresponding prize indicia to the vendor identified in the prize description.

The present game of chance is particularly fun for subscribers or recipients thereof and offers them the opportunity to claim valuable prizes. Further, it is beneficial to advertisers therein as it will entice the subscribers or recipients to review the contents of the publication in order to determine if they are entitled to claim a prize. Thus, the present game of chance may increase advertising revenue to the publisher since publications which include the present game may become particularly desirable for advertisers.

The foregoing description of the preferred embodiments and methods have been provided by way of example only. Thus, it should be understood that various modifications can be made, and in fact are encouraged to be made, in the particular features of the present game of chance and the method of playing the game without departing from the spirit and scope of the present invention which is set forth in the following claims.

I claim:

1. A game of chance comprising:

a publication including at least one page;

prize information identifying a prize printed on said at least one page;

first indicia also printed on said at least one page corresponding to said prize information;

a mailing label affixed to said publication so that it is visible from the outside of said publication, said mailing label including a recipient's address to assure delivery of said publication via mail and second indicia printed thereon, said second indicia corresponding to said first indicia and thus being winning indicia, whereby a recipient who receives a copy of said publication including said winning indicia can immediately claim the prize identified by said prize information.

2. The game of claim 1 wherein each of said mailing label includes a unique one of said second indicia.

3. The game of claim 1 wherein said second indicia comprises numbers.

4. The game of claim 3 wherein said second indicia of said mailing label comprises consecutive numbers.

5. The game of claim 3 wherein said second indicia is randomly assigned to said mailing label.

6. The game of claim 1 wherein said second indicia comprises letters.

7. The game of claim 1 wherein said prize information comprises a listing of a plurality of prizes, and said first indicia comprises a plurality of separate entries which correspond to respective ones of said listed prizes.

8. The game of claim 7 wherein said second indicia may correspond with only one of said entries of said first indicia.

9. The game of claim 1 wherein said prize information comprises at least one coupon and said first indicia comprises at least one entry corresponding with said at least one coupon.

10. The game of claim 1 wherein said publication is selected from the group consisting of newspapers, home shopper publications and magazines.

11. The game of claim 1 wherein each of said mailing label includes one set of said second indicia.

12. A method of playing a game of chance comprising the steps of:

receiving a publication in the mail;

examining a mailing label provided on the publication used to assure delivery of said publication to a recipient via mail where said mailing label is visible from the outside of said publication, and identifying indicia printed on said mailing label;

examining at least a portion of said publication and identifying prize indicia and corresponding listed prize information printed on said publication; and comparing said mailing label indicia with said prize indicia to determine if a match exists between such respective indicia, whereby upon detection of a match, the player can immediately claim the prize or prizes listed.

* * * * *